US006688278B2

(12) United States Patent
Rodriguez-Amaya et al.

(10) Patent No.: US 6,688,278 B2
(45) Date of Patent: Feb. 10, 2004

(54) METHOD AND DEVICE FOR SHAPING THE INJECTION PRESSURE COURSE IN INJECTORS

(75) Inventors: Nestor Rodriguez-Amaya, Stuttgart (DE); Roger Potschin, Brackenheim (DE); Ulrich Projahn, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 37 days.

(21) Appl. No.: 09/979,500

(22) PCT Filed: Mar. 20, 2001

(86) PCT No.: PCT/DE01/01059

§ 371 (c)(1),
(2), (4) Date: Mar. 27, 2002

(87) PCT Pub. No.: WO01/71177

PCT Pub. Date: Sep. 27, 2001

(65) Prior Publication Data

US 2002/0162528 A1 Nov. 7, 2002

(30) Foreign Application Priority Data

Mar. 23, 2000 (DE) ..... 100 14 451

(51) Int. Cl.[7] ..... F02B 3/00
(52) U.S. Cl. ..... 123/299; 123/498
(58) Field of Search ..... 123/299, 300, 123/446, 467, 498, 506, 514; 239/88, 533.2

(56) References Cited

U.S. PATENT DOCUMENTS

| | | | | | |
|---|---|---|---|---|---|
| 4,958,610 | A | * | 9/1990 | Yamamoto et al. | 123/478 |
| 5,499,608 | A | * | 3/1996 | Meister et al. | 123/467 |
| 5,732,679 | A | * | 3/1998 | Takahasi et al. | 123/467 |
| 5,771,865 | A | * | 6/1998 | Ishida | 123/467 |
| 6,378,487 | B1 | * | 4/2002 | Zukouski et al. | 123/299 |
| 6,470,849 | B1 | * | 10/2002 | Duffy et al. | 123/299 |
| 6,540,160 | B2 | * | 4/2003 | Rodriguez-Amaya et al. | 239/533.2 |
| 6,575,139 | B2 | * | 6/2003 | Rodriguez-Amaya et al. | 123/467 |

* cited by examiner

*Primary Examiner*—Mahmoud Gimie
(74) *Attorney, Agent, or Firm*—Ronald E. Greigg

(57) ABSTRACT

The invention relates to a method for shaping the injection pressure course (27) in injectors, which are used for instance in injection devices of injection systems in motor vehicles. The injection device includes a pump part (1) and an injection nozzle part (2). The pump part (1) and injection nozzle part (2) communicate with one another via a high-pressure line (3). Control valves (8, 10) which are triggered by means of an actuator (9) are contained in the pump part (1). By the triggering by means of the actuator (9), injection parameters during the preinjection phase (28), pressure buildup phase (29) and main injection phase (30) are determined.

10 Claims, 4 Drawing Sheets

METHOD AND DEVICE FOR SHAPING THE INJECTION PRESSURE COURSE IN INJECTORS

CROSS-REFERENCE TO RELATED APPLICATIONS

This application is a 35 USC 371 application of PCT/DE 01/01019 filed on Mar. 20, 2001.

BACKGROUND OF THE INVENTION

1. Field of the Invention

The invention relates to a method and a device for shaping the injection pressure course in injectors. Injectors and injection systems in which the injectors are used are employed to supply fuel to internal combustion engines of motor vehicles.

2. Prior Art

In the procedure of the prior art, in order to vary the course of the injection pressure during the injection, the volume of fuel positively displaced by the pump piston in the pump part of an injector housing is in part blown out via a slightly open control valve. Without the opening of the control valve, a continuous increase in the injection pressure would occur. This procedure is known by the abbreviation CCRS (for Current Controlled Rate Shaping), in which magnet valves, in particular, are used as units that actuate the control valves.

In another embodiment representing the prior art, a magnet valve is provided which serves the purpose of pressure buildup, along with a further pressure valve, which as a valve to be located downstream serves solely to regulate the pressure level during the pressure buildup phase (boot phase).

With the embodiments of the prior art, only individual phases of the injection pressure course can be regulated during the injection. A more-extensive shaping of the injection pressure course, along with a substantially more-compact structural shape of injectors, is not possible since the embodiments described here use magnet valves that take up space on the one hand and on the other need further magnet valves in order to shape the injection pressure course in more detail.

SUMMARY OF THE INVENTION

With the method and the device proposed according to the invention, both the duration of the preinjection phase and the duration of the pressure buildup phase can be determined by the triggering by means of an actuator. Furthermore, with the method proposed, specifying the pressure to various pressure level values during the pressure buildup phase is possible. The same is analogously true for setting the height of the allowable and mechanical still tolerable maximum pressure toward the end of the main injection phase. Depending on the load-bearing capacity of the mechanical components, a pressure limitation toward the end of the main injection phase can be adapted to the applicable conditions of use of the injection system. It is furthermore possible with the method proposed according to the invention to assure that a diversion rate adapted variably to given conditions of use can be set. Depending on the intended use, the course of the pressure reduction can be preselected such that the instant of the end of the main injection and the instant of the onset of the pressure reduction phase can each be adapted individually.

With the method proposed according to the invention, the pump part of an injector system can be designed such that merely a single pump can be used for various designs of internal combustion engines. The pressure buildup phase for instance, which directly follows the preinjection phase, can be initiated by an actuator control in accordance with the intended use, regardless of how the nozzles and pump pistons are designed.

The course of the pressure in the pressure buildup phase is also independent of the load and the torque in the instantaneous operating state of the engine and can for instance be preselected precisely such that the pressure in the pressure buildup phase is just above the opening pressure for the nozzle needle received movably in the injector housing.

Another advantage attainable by means of the method of the invention is that the control valves can be moved into the sealing seat for the pressure buildup phase. As a result, it is possible to expand the actuator stroke tolerances, which makes the production of the actuator less expensive, since the protection against leakage losses for fuel that is at high pressure is assured by means of the control valves that have moved into their sealing position.

Triggering the control valves by means of a piezoelectric actuator makes it possible to dispense with magnet valves which take up greater space, and as a result the injector can be designed with an extremely compact construction.

BRIEF DESCRIPTION OF THE DRAWINGS

The invention is described in further detail below in conjunction with the drawings, in which.

DESCRIPTION OF THE PREFERRED EMBODIMENTS

Figure 1:
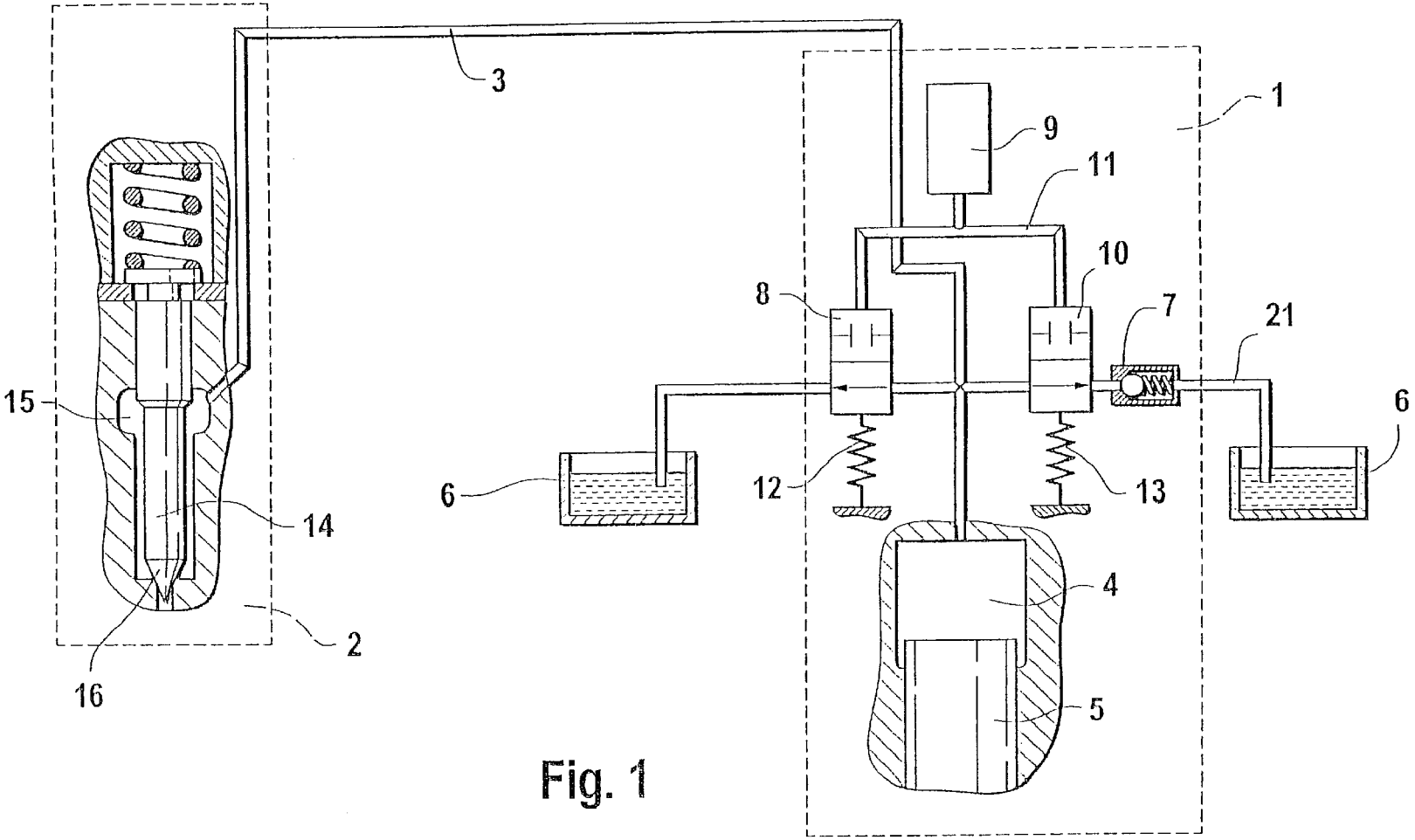
FIG. 1 illustrates the pump part of an injector, which communicates by means of a high-pressure line with the injection nozzle part of the injector.

The pump part 1 communicates with the injection nozzle part of the injector via the high-pressure line 3. In the pump part 1, the pump chamber 4 is acted upon by a piston 5. Two control valves 8 and 10 are associated with the high-pressure line 3 and disposed downstream of the pump chamber 4. The control valves 8 and 10 are each acted upon by a respective force storing means 12 or 13, and the force storing means 12 or 13 are adapted to the desired opening characteristic of the two control valves 8 and 10, respectively. The control valves 8 and 10 communicate with respective pressure chambers 6 that have a lower pressure level, into which chambers excess blown-off fuel can be diverted. The fuel tank of a motor vehicle, for instance, can be considered as an example of such lower-pressure-level pressure chambers.

An equal-pressure valve 7 is assigned to one of the control valves 8 and 10, specifically in the view shown in FIG. 1 to the control valve 10; this equal-pressure valve is provided in the return line from the second control valve 10 into the low-pressure chamber 6, or in other words into the supply line to the fuel tank. As an alternative, it is conceivable to dispose the equal-pressure valve 7 upstream of the control valve 10. By that means, the control valve 10, because less pressure is exerted on it, could be designed in a more lightweight embodiment. The two control valves 8 and 10 are acted upon by separate force storing means 12 and 13, respectively, by which the opening characteristic of the first and second control valves 8, 10 can be set. A coupling chamber 11 is provided above the two control valves 8 and 10; above the coupling chamber 11, an actuator 9 is provided—preferably embodied as a piezoelectric actuator with which extremely fast switching times are attainable—with which the control parts of the first and second control valves 8 and 10 can be triggered. The use of a piezoelectric actuator instead of magnet valves makes it possible to embody the pump part 1 of the injector of the injection system extremely compactly.

The high-pressure line 3 for transporting the fuel that is at high pressure leads from the pump part 1 to the injection nozzle part 2 and discharges into a control chamber 15, which surrounds the nozzle needle 14 of the injector. The tip of the nozzle needle 14 forms the nozzle 16, which discharges into the corresponding combustion chambers of the engine.

Figure 2:
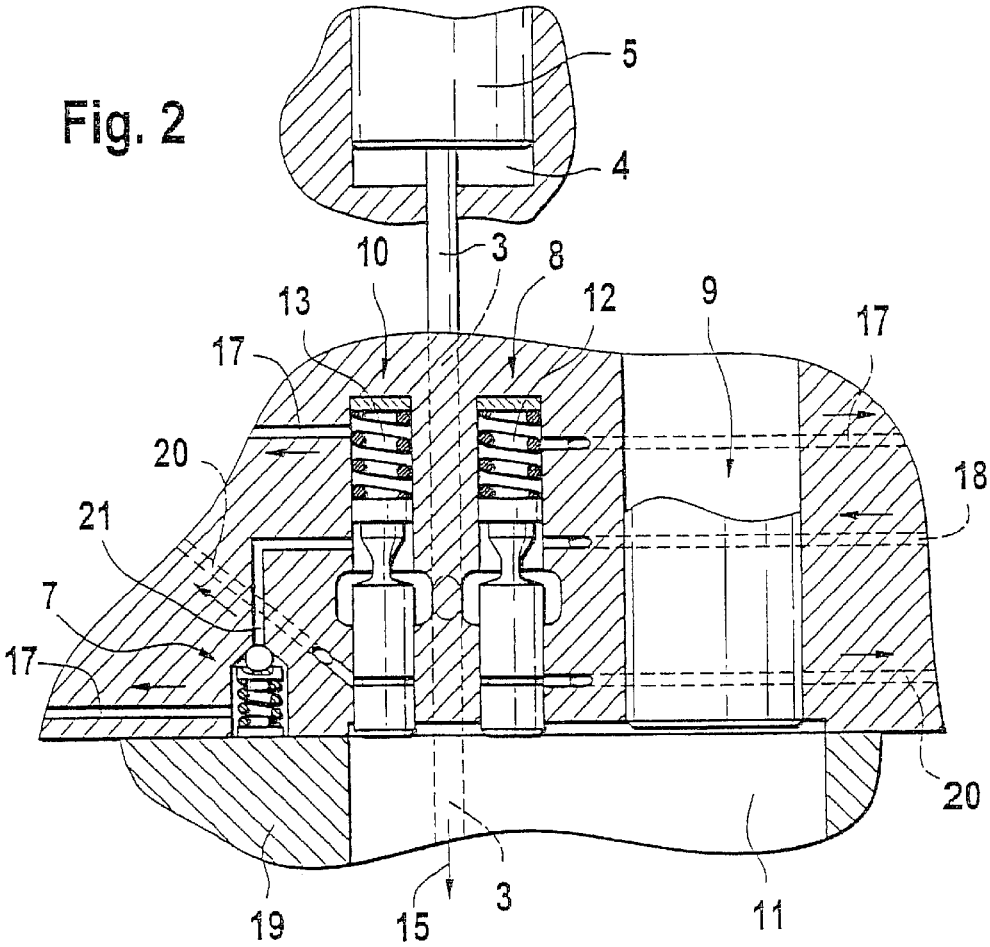
FIG. 2 illustrates the disposition of the control valves in the pump part of the injector.

FIG. 2 shows the disposition of the control valves in the pump part of the injector.

The motion of the piston 5 causes a pressure increase of the incompressible fuel medium. Via the supply line 18, the fuel that is at high pressure communicates with chambers, surrounding the control parts, of the control valves 8 and 10. Each of the control valves 8 and 10 is provided with a respective force storing means, with which the control part of valves 8 and 10 can be kept open in prestressed fashion. The control chamber of the second control valve 10 communicates with the equal-pressure valve 7, by whose prestressing the diversion rate can be kept variable. Both the various piston parts and the hollow chambers in which the force storing means 12, 13 of the two control valves 8 and 10 are received communicate, via outlet lines 17 and 20, respectively, with the low-pressure chambers 6, such as the fuel tank, into which the excess fuel can be diverted.

As shown in FIG. 1, the control parts of the control valves 8, 10 can be moved into different partly open positions by the triggering via the actuator 9. In the applicable open position or partly open position or closed position—for instance of the second control valve 10, triggerable by the actuator 9—a certain fuel quantity, corresponding to the opening cross section uncovered, can then flow out during a likewise preselectable period of time, for instance into the fuel tank 6, and as a result the injection pressure can be modeled accordingly.

Figure 3:
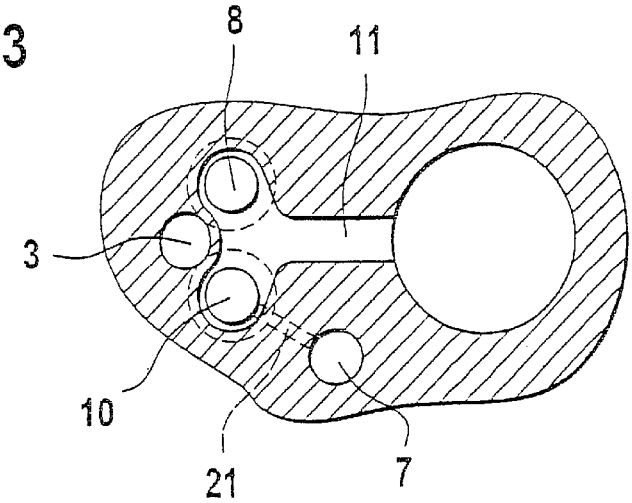
FIG. 3 is a fragmentary sectional view of on the coupling chamber.

FIG. 3 shows the plan view of the arrangement in FIG. 2.

The compact construction of the pump part 1 and injection nozzle part 2 is due to the course of the high-pressure line 3 between the first and second control valves 8 and 10. Dashed lines show the control chambers surrounding the control valves 8 and 10. The connecting line 21 from the second control valve 10 to the equal-pressure valve 7 is also shown in dashed lines. From the relative positions, visible in the plan view, of the high-pressure line 3, the two control valves 8, 10, and the equal-pressure valve 7, the compact design of the injector is apparent.

Figure 4:
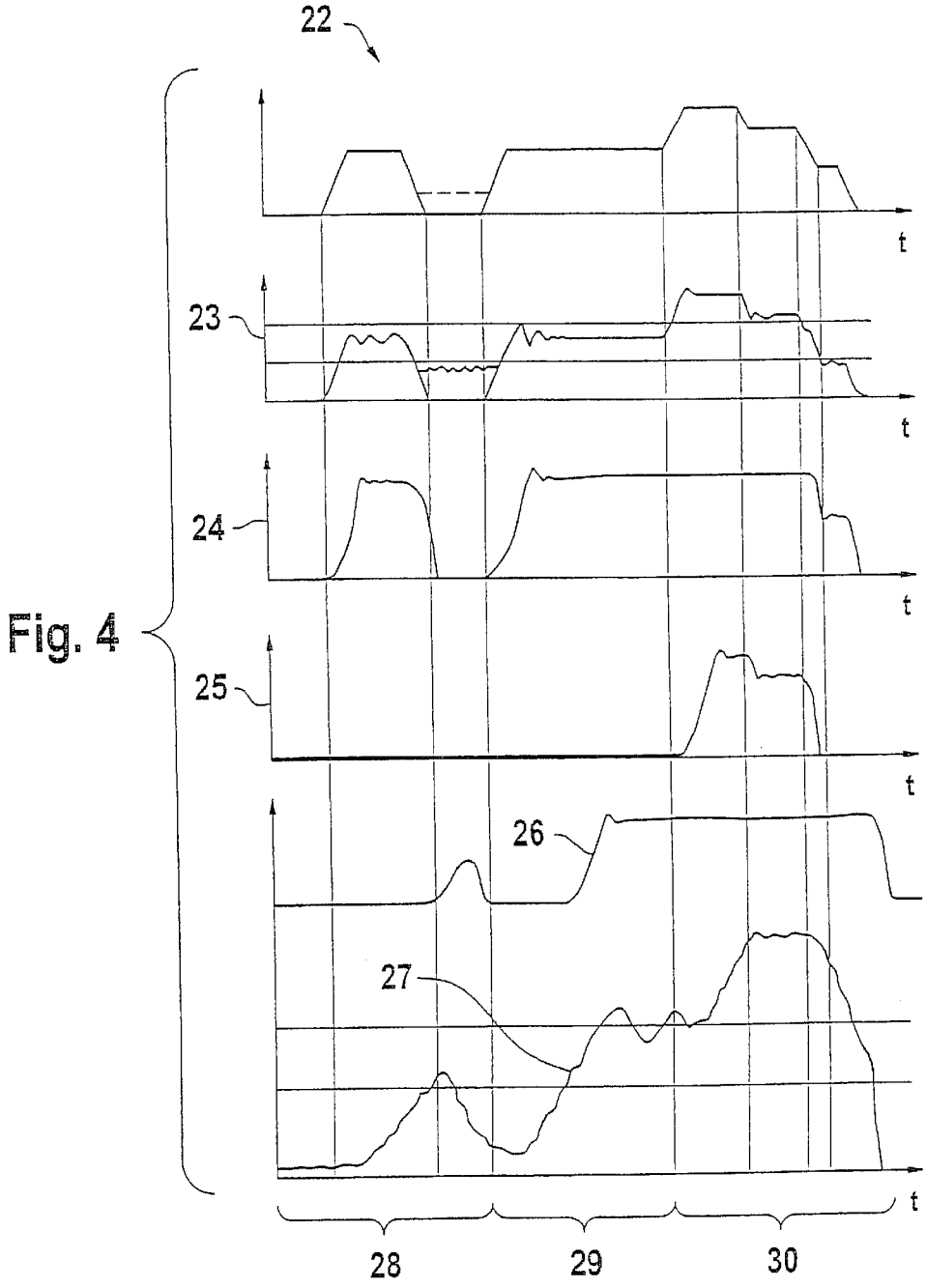
FIG. 4 graphically illustrates the stroke and pressure courses for the components of the injection system that accomplish the injection event.
Figure 5:
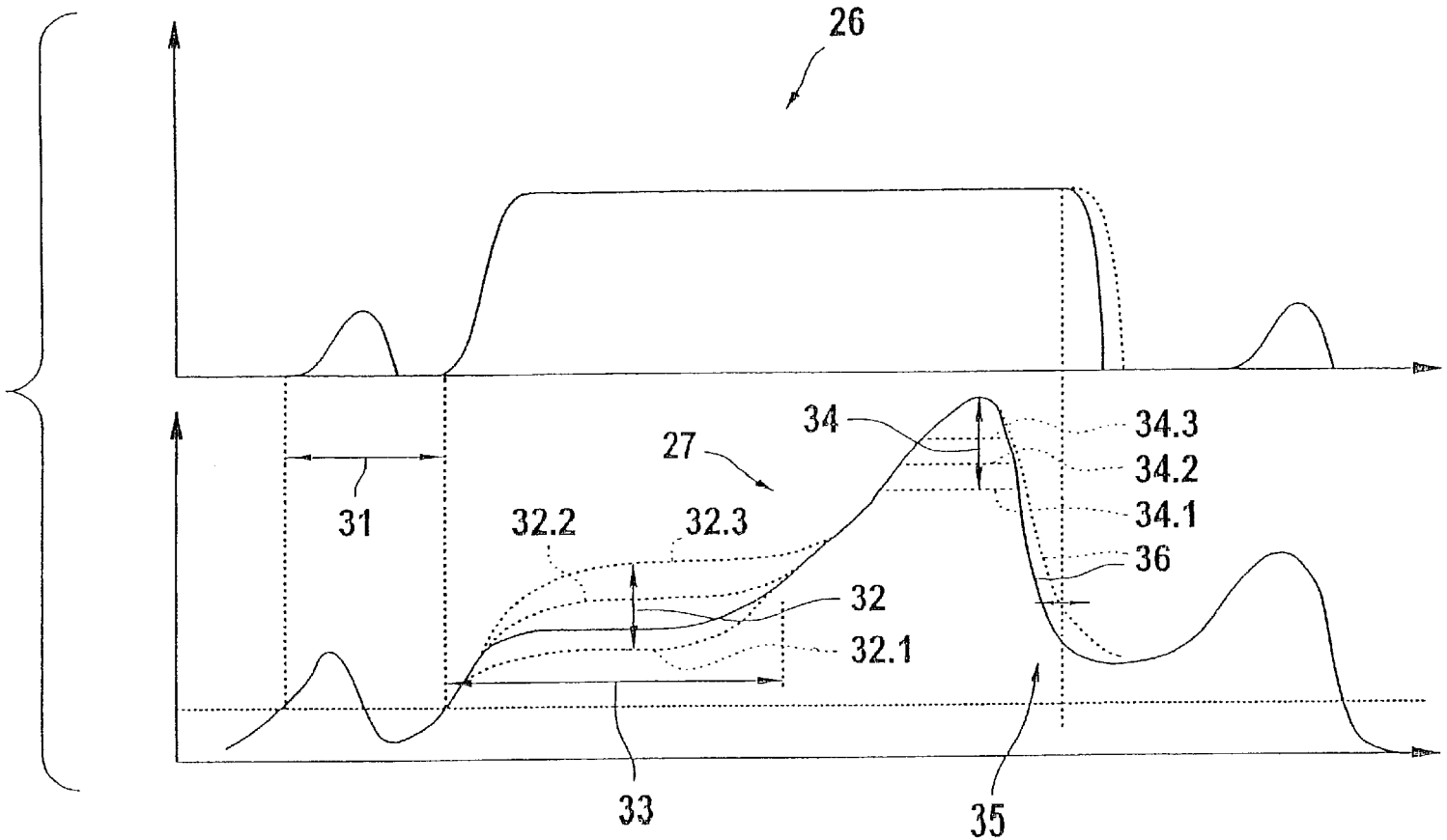
FIG. 5 illustrates the nozzle needle stroke length along with the injection pressure course that can be shaped, in each case plotted over the time axis and compared with one another.

FIG. 4 shows the various stroke and pressure courses at the components that bring about the injection event in the internal combustion engine. These courses can be subdivided into a preinjection phase 28, a pressure buildup phase 29, and a main injection phase 30. These are followed by a pressure reduction phase 35. as shown in FIG. 5. The pressure established in the coupling chamber 11, shown in graph 23, is a direct replica of the stroke course of the actuator 9 shown in the first graph 22.

In the graphs 24 and 25, the stroke lengths that are established in the control valves 8, 10 are each plotted over the time axis. Accordingly, with the first control valve 8, the preinjection phase and the main load of the ensuing pressure buildup phase 29 as well as of the main injection phase 30 are accomplished. The oscillation range of the control part in the first control valve 8, located in graph 24 between the end of the preinjection phase 28 and the onset of the pressure buildup phase 29, is represented by an undulating line.

From graph 25, which shows the stroke length of the control part in the second control valve 10, it can be seen that the control part of this control valve 10 remains unactuated during the preinjection phase 28 and the pressure buildup phase 29; for that length of time, the stroke length is equal to zero. Not until the onset of the main injection phase 30 is the second control valve 10 triggered by means of the actuator 9 so that it contributes accordingly to the desired pressure level 34.1, 34.2, 34.3 (FIG. 5) during the main injection phase 30 to increase the pressure in the maximum pressure phase of the injection event.

In the graph shown at the bottom in FIG. 4, the nozzle needle stroke length 26 and the injection pressure course 27 during the preinjection phase 28, the pressure buildup phase 29 (boot phase) and the main injection phase 30 are shown, and in FIG. 5 the pressure reduction phase 35 is shown. With respect to the injection pressure course 27, it can be seen from a comparison of the stroke length courses 24 and 25 of the two control valves Band 10, respectively, that the pressure increase toward the end of the main injection phase 30 is effected by triggering of the second control valve 10 into its sealing closing position, so that the bypass to the low-pressure chamber 6—that is, the fuel tank—is closed, and the maximum pressure occurs at the nozzle 16 (FIG. 1). The pressure increase during the injection pressure course 27 toward the end of the main injection phase 30, and its level 34.1, 34.2, and 34.3 (see FIG. 5), are attained solely by the second control valve 10; the nozzle needle stroke 26 remains constant during the pressure buildup phase 29 and the main injection phase 30.

FIG. 5 shows the nozzle needle stroke 26, plotted over the time axis, along with the injection pressure course 27 that can be shaped.

The injection pressure course 27 shown in the bottom graph of FIG. 4 is shown in further detail in FIG. 5. Reference numeral 31 indicates the duration of the preinjection phase 28; the preinjection phase 28 is followed by the pressure buildup phase 29, in which the various pressure levels 32.1, 32.2 and 32.3 can be set as shown in FIG. 5. With the settability of the pressure level, it is possible with one injector to meet the requirements of the most various designs of internal combustion engines. Application-specific settings can be made, so that by the flexible triggerability by means of the actuator 9, one component can be adapted to various possible uses, so that the number of variants required can be reduced drastically.

Reference numeral 33, shown in FIG. 5, indicates the duration of the pressure buildup phase 29, but with more detail than is shown by 29 in FIG. 4. The pressure buildup phase 29, also called the boot phase, merges with the main injection phase 30, as shown in FIG. 4. As shown in FIG. 5, this phase can be increased by means of a further steady pressure increase 34—beginning at a pressure attained in the pressure buildup phase 29—to a preselectable maximum pressure level 34.1, 34.2, 34.3.

The applicable pressure level 34.1, 34.2 and 34.3 can be preset by means of the second control valve 10. By opening of the return line, in which the equal-pressure valve 7 is received, the fuel can flow out into the low-pressure chamber 6, that is, into the fuel tank. By means of the setting of the pressure level 34.1, 34.2 and 34.3, the maximum pressure can be set to suit requirements, so that the mechanical components of the injector can be protected against damage from excessively high incident pressures.

Furthermore, because of the actuator control effected by a piezoelectric actuator, independently of the rpm and load course, a variable course, as indicated by 36 can be obtained during the pressure reduction phase 35. The course of the pressure reduction can be adapted to individual requirements of the particular intended use by means of varying the slope 36.

The foregoing relates to preferred exemplary embodiments of the invention, it being understood that other variants and embodiments thereof are possible within the spirit and scope of the invention, the latter being defined by the appended claims.

We claim:

1. A method for shaping the injection pressure course (27) in injection devices for internal combustion engines, comprising the steps of:

providing an injection device with a pump part (1) and an injection nozzle part (2), which communicate with one another via a high-pressure line (3), providing control valves (8, 10) in the pump part (1), and triggering the control valves (8, 10) by an actuator (9) to determine injection parameters during the preinjection phase (28), pressure buildup phase (29) and main injection phase (30).

2. The method for shaping the injection pressure course of claim 1, wherein the duration (31) of the preinjection phase (28) is varied by the triggering of the first control valve (8) by means of the actuator (9).

3. The method for shaping the injection pressure course of claim 1, wherein the duration (33) of the pressure buildup phase (29) is determined by the triggering of the first control valve (8) by means of the actuator (9).

4. The method for shaping the injection pressure course of claim 1, wherein the pressure level (32) during the pressure buildup phase (29) is determined by triggering of the first control valve (8).

5. The method for shaping the injection pressure course of claim 4, wherein the pressure level (32) during the pressure buildup phase (29) is selectively set to different pressure levels (32.1, 32.2, 32.3).

6. The method for shaping the injection pressure course of claim 1, wherein the high-pressure level (34) during the terminal phase of the main injection phase (30) is controlled by triggering of the second control valve (10) by means of the actuator (9).

7. The method for shaping the injection pressure course of claim 6, wherein the high-pressure level (34) during the main injection phase (30) is selectively adjusted to different pressure levels (34.1, 34.2, 34.3).

8. The method for shaping the injection pressure course of claim 1, wherein a pressure limitation during the main injection phase (30) is adjusted by triggering of a second control valve (10) by means of the actuator (9).

9. The method for shaping the injection pressure course of claim 1, wherein a variable diversion rate of fuel into a low-pressure region (6) is attained by triggering of the second control valve (10) into a partly open position.

10. A device for shaping the injection pressure course (27) in an injection device for internal combustion engines, said injection device comprising a pump part (1) and an injection nozzle part (2) which communicate with one another via a high-pressure line (3), and control valves (8, 10) received in the pump part, said control valves (8, 10) being positionable independently of one another into closed and/or partly open positions by means of a piezoelectric actuator (9), and an equal-pressure valve (7) associated with one of the control valves (8, 10).

* * * * *